US006634402B2

(12) United States Patent
Chen

(10) Patent No.: US 6,634,402 B2
(45) Date of Patent: Oct. 21, 2003

(54) ADHESIVE-TAPE HOLDER WITH AN OPENABLE SIDE COVER

(76) Inventor: Hsiu-Man Yu Chen, No. 27, Sec. 1, Dafu Rd., Tantz Shiang, Taichung (TW), 427

( * ) Notice: Subject to any disclaimer, the term of this patent is extended or adjusted under 35 U.S.C. 154(b) by 0 days.

(21) Appl. No.: 10/066,615

(22) Filed: Feb. 6, 2002

(65) Prior Publication Data

US 2003/0145953 A1 Aug. 7, 2003

(51) Int. Cl.[7] ..... B32B 31/00

(52) U.S. Cl. ..... 156/527; 156/486; 156/576; 156/577; 156/579; 225/46

(58) Field of Search ..... 156/527, 526, 156/524, 523, 575, 576, 577, 579, 486; 225/46

(56) References Cited

U.S. PATENT DOCUMENTS 3,850,779 A * 11/1974 Pearson ..... 156/523
5,073,228 A * 12/1991 Lin ..... 156/523
5,236,540 A * 8/1993 Shi ..... 156/523
5,725,726 A * 3/1998 Yu ..... 156/577
5,849,144 A * 12/1998 Tang et al. ..... 156/577

* cited by examiner

*Primary Examiner*—Linda Gray
(74) *Attorney, Agent, or Firm*—Troxell Law Office PLLC

(57) ABSTRACT

An adhesive-tape holder with an openable side cover has an openable side cover positioned symmetrically opposite to a stationary side plate. The side cover has the combining tubular rod and a first and a second fitting rods respectively received in the combining tube and the roller support tube and the connecting tube of the side plate to make up three combining positions, capable to stabilize the adhesive-tape roller and prevent it from dropping out of an adhesive-tape roller base.

5 Claims, 6 Drawing Sheets

ADHESIVE-TAPE HOLDER WITH AN OPENABLE SIDE COVER

BACKGROUND OF THE INVENTION

This invention relates to an adhesive-tape holder with an openable side cover, particularly to one having a openable side cover provided on one side and combined with a combining tube, a roller support tube and a fitting tube at three locations, capable to stabilize an adhesive-tape roller and protect an adhesive-tape roller from dropping out of an adhesive-tape roller base.

A conventional adhesive-tape holder, as shown in FIG. 1, includes a handle 1 provided with an adhesive-tape roller base 2 on top for receiving an adhesive-tape roller, a blade base 3, a blade 4 and a press plate 5 combined together. In using the adhesive-tape holder, the adhesive tape on the adhesive-tape roller base 2 is first pulled out to pass through a roller 6 and then onto the press plate 5. Then, the tape adhered on an article is pressed flat by the press plate 5 and then cut off by the blade 4 on the blade base 3.

However, the adhesive-tape roller base 2 of the conventional adhesive-tape holder is of an open style so it is liable to drop out in case of carelessness in using. Besides, the blade 4 is fixedly mounted on the blade base 3, therefore when cutting an adhesive tape, which has flexibility, the blade 4 may pull and drag the adhesive tape and fail to cut it off precisely and linearly.

SUMMARY OF THE INVENTION

A main objective of this invention is to offer an adhesive-tape holder with an openable side cover, having a side cover symmetrically combined with the adhesive-tape holder body by engagement at three locations, capable to protect an adhesive-tape roller from dropping out of an adhesive-tape roller base.

Another objective of this invention is to offer an adhesive-tape holder with an openable side cover, having a blade sandwiched by a blade slide base and a blade holder and restrictedly guided therebetween, so that it is able to cut off an adhesive tape with precision.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
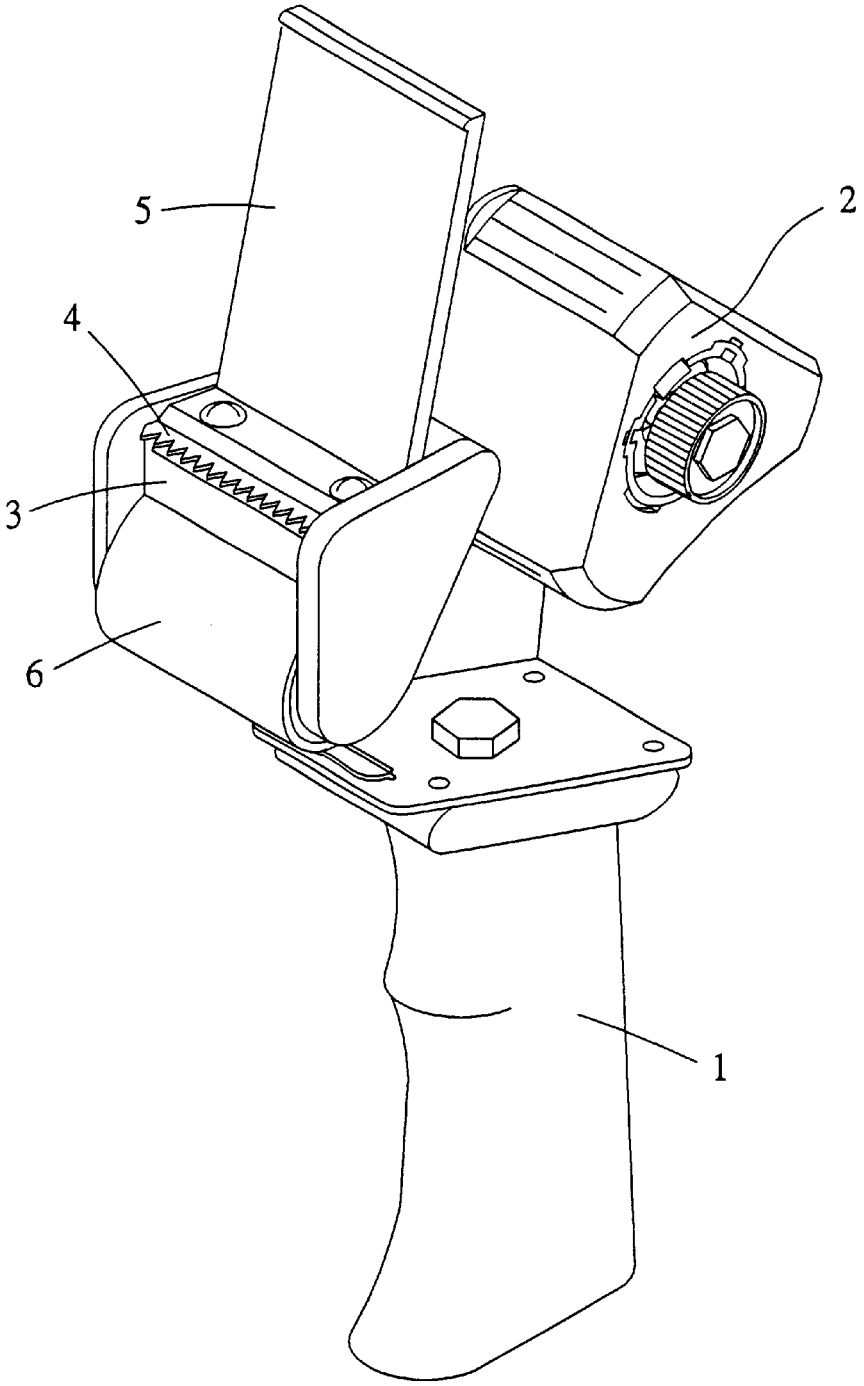
FIG. 1 PRIOR ART
FIG. 1 is a perspective view of a conventional adhesive-tape holder.
Figure 2:
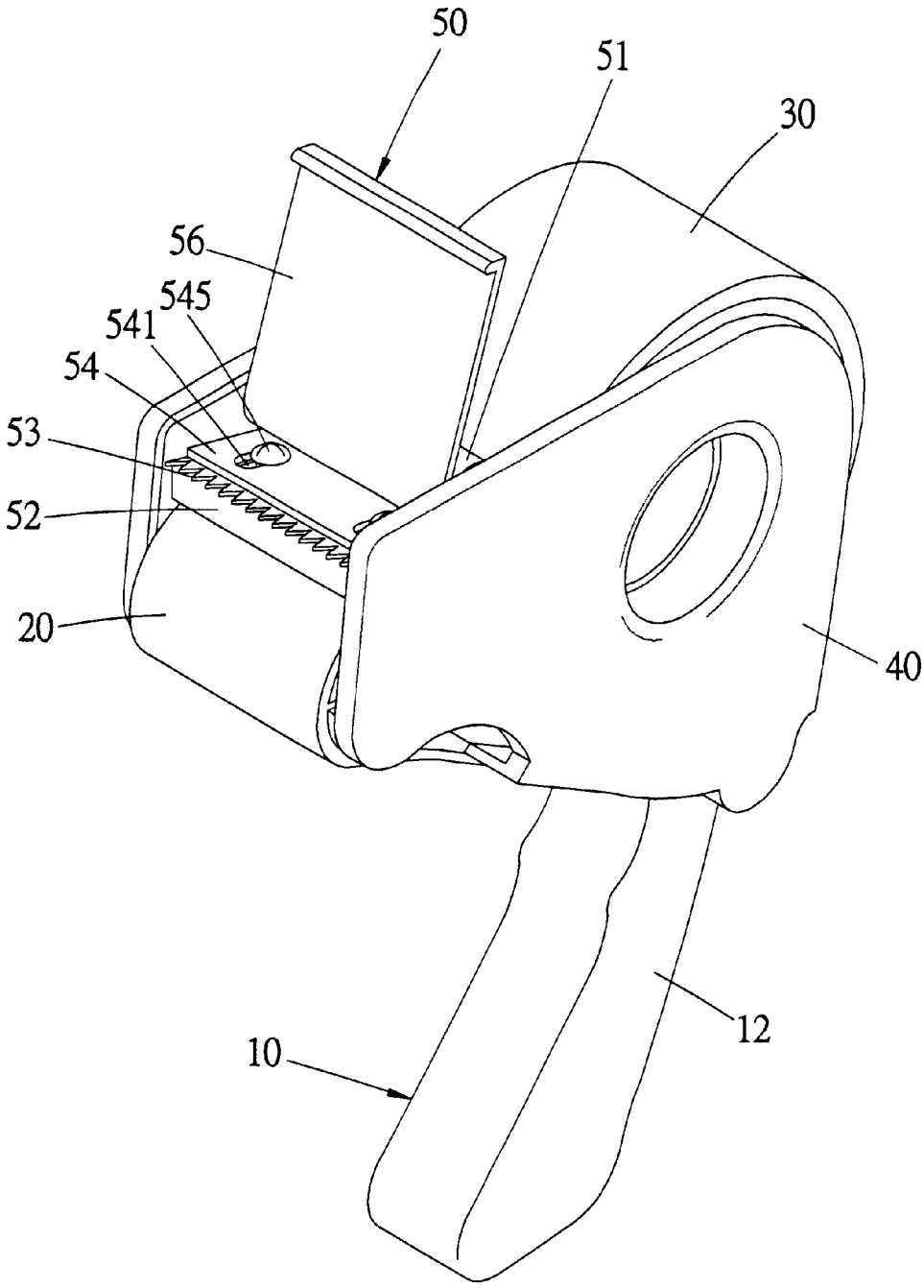
FIG. 2 is a perspective view of a first embodiment of an adhesive-tape holder with an openable side cover in the present invention.
Figure 3:
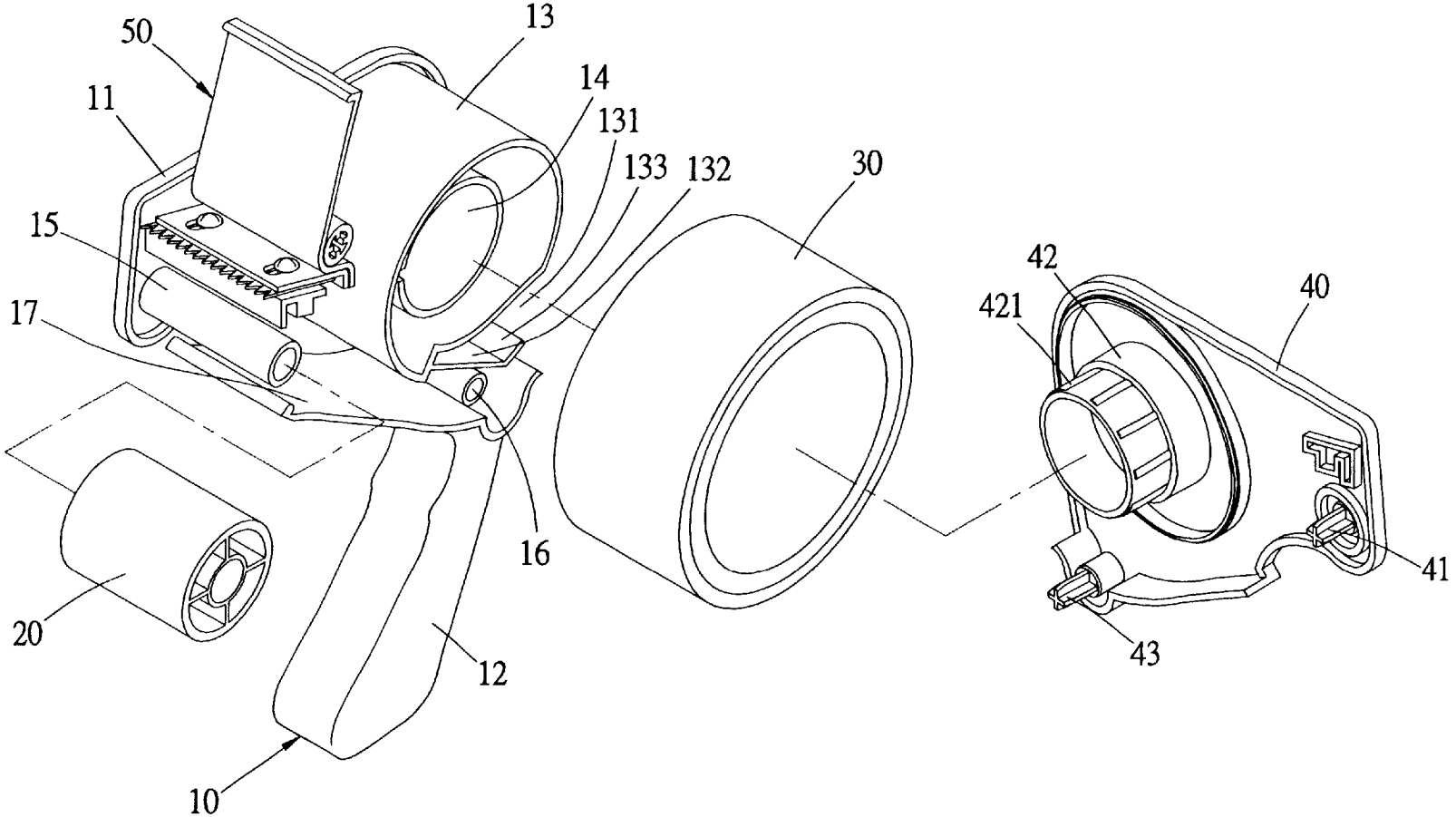
FIG. 3 is an exploded perspective view of the first embodiment of the adhesive-tape holder with an openable cover in the present invention.

A first preferred embodiment of an adhesive-tape holder 10 with an openable side cover in the present invention, as shown in FIGS. 2 and 3, includes a stationary side plate 11, a handle 12, an adhesive-tape roller base 13, a roller 20, an adhesive-tape roller 30, an openable side cover 40 and a cutting device 50 as main components combined together.

The handle 12 is located under one side of the side plate 11, and the adhesive-tape roller base 13 is fixed laterally with one end of the side plate, formed with an inner recess 131 on its circumferential surface. The inner recess 131 has a stop plate 132 extending out of its edge and formed integral with the adhesive-tape roller base 13, with an open end 133 of the stop plate 132 blocking the adhesive-tape roller 30 from rotating in a reverse direction.

In addition, the adhesive-tape roller base 13 is centrally formed with a combining tube 14 and extending out of the side plate 11. Then, the side plate 11 is provided at the front end with a roller support tube 15 extending laterally from the side plate 11, and a fitting tube 16 also extending laterally from the side plate above the handle 12. Thus, the combining tube 14, the roller support tube 15 and the fitting tube 16 together make up three combining locations.

Further a stop plate 17 is fixed on the upper side of the handle 12, extending forward and having its side edge disconnected with a gap from the side plate 11, and a cutting device 50 is disposed above the roller support tube 15 for cutting off an adhesive tape.

The roller 20 is fitted around the roller support tube 15, having its circumferential surface stopped by the stop plate 17.

The adhesive-tape roller 30 is fitted around the adhesive-tape roller base 13, with an adhesive tape placed around the adhesive-tape roller 30 possible to be pulled out to pass through between the roller 20 and the stop plate 17 and then onto the cutting device 50.

The opeanble side cover 40 is positioned above one side of the handle 12, symmetrically located opposite to the side plate 11. The side cover 40 is provided with a first fitting rod 41 of a cross shape to be inserted in the roller support tube 15, and a step-shaped combining tubular rod 42 stably inserted in the combining tube 14 of the adhesive-tape roller base 1 and having a plurality of ridges 421 formed spaced apart around its circumferential surface, and further a cross-shaped second fitting rod 43 inserted in the fitting tube 16 on the side plate 11.

Figure 4:
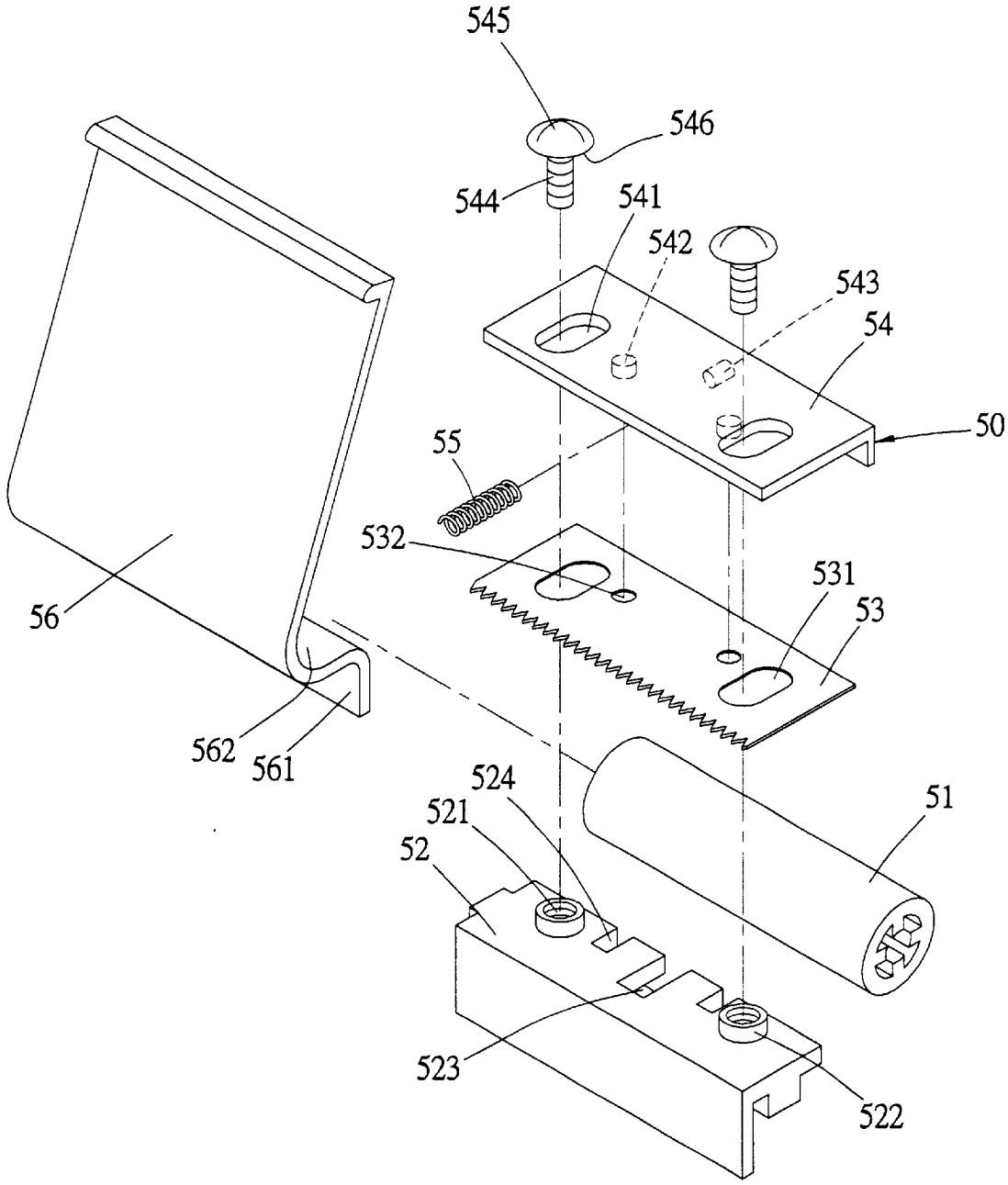
FIG. 4 is an exploded perspective view of the first embodiment of an automatic cutting device of the ahesive-tape holder in the present invention.

The cutting device 50, as shown in FIG. 4, includes a support rod 51, a blade holder 52, a blade 53, a slide base 54, a spring 55 and a press plate 56 combined together.

The support rod 51 is set on a support member 562 of the press plate 56 positioned between the adhesive-tape roller base 13 and the roller support tube 15.

The blade holder 52 is disposed on the inner side wall of the side plate 11 under the support rod 51, having two fixing studs 522 provided spaced apart on top and respectively having a threaded hole 521, a spring receiving groove 523 formed in the center and two slide grooves 524 respectively bored at the left and the right side of the spring receiving groove 523.

The blade 53 is mounted on the blade holder 52, having two slide holes 531 corresponding to the threaded holes 521 of the blade holder 52 and fitted around the fixing studs 522 of the blade holder 52, and then two position holes 532 provided to conform to the slide grooves 524 of the blade holder 52.

The slide base 54 is mounted on the blade 53 and activates it to shift. The slide base 54 is provided with two oval slide holes 541 matching with the slide holes 531 of the blade 53 and two position studs 542 protruding downward to pass through the position holes 532 of the blade 53 and then get in the slide groove 524 of the blade holder 52. The slide base 54 further has a lateral projecting stud 543 on its vertical short wall.

The spring 55 has one end fitted around the projecting stud 543 and the other end inserted in the spring receiving groove 523 of the blade holder 52.

The press plate 56 is formed with a lower vertical push member 561 at the lower end to push the slide base 54, and has a curved support member 562 formed between an upper vertical press member and the lower push member 561 to rest against the support rod 51.

In assembling, the adhesive-tape roller 30 is first fitted around the adhesive-tape roller base 13, with the stop plate 17 stopping the inner side of the adhesive-tape roll 30 to prevent it from rotating in a reverse direction. Next, an adhesive tape is placed around the adhesive-tape roller 30 and pulled out to pass through the roller 20 and get onto the cutting device 50, and then the side cover 40 is covered on one side of the handle 12 and the adhesive-tape roller 30 with the combining tubular rod 42, the first and second fitting rods 41 and 43 respectively received in the combining tube 14 and the roller support tube 15 and the fitting tube 16 of the side plate 11. Thus, the adhesive-tape roller 30 has its left and right sides respectively restricted and supported by the stationary side plate 11 and the openable side cover 40 to be protected therebetween from dropping out of the adhesive-tape roller base 13.

Figure 5:
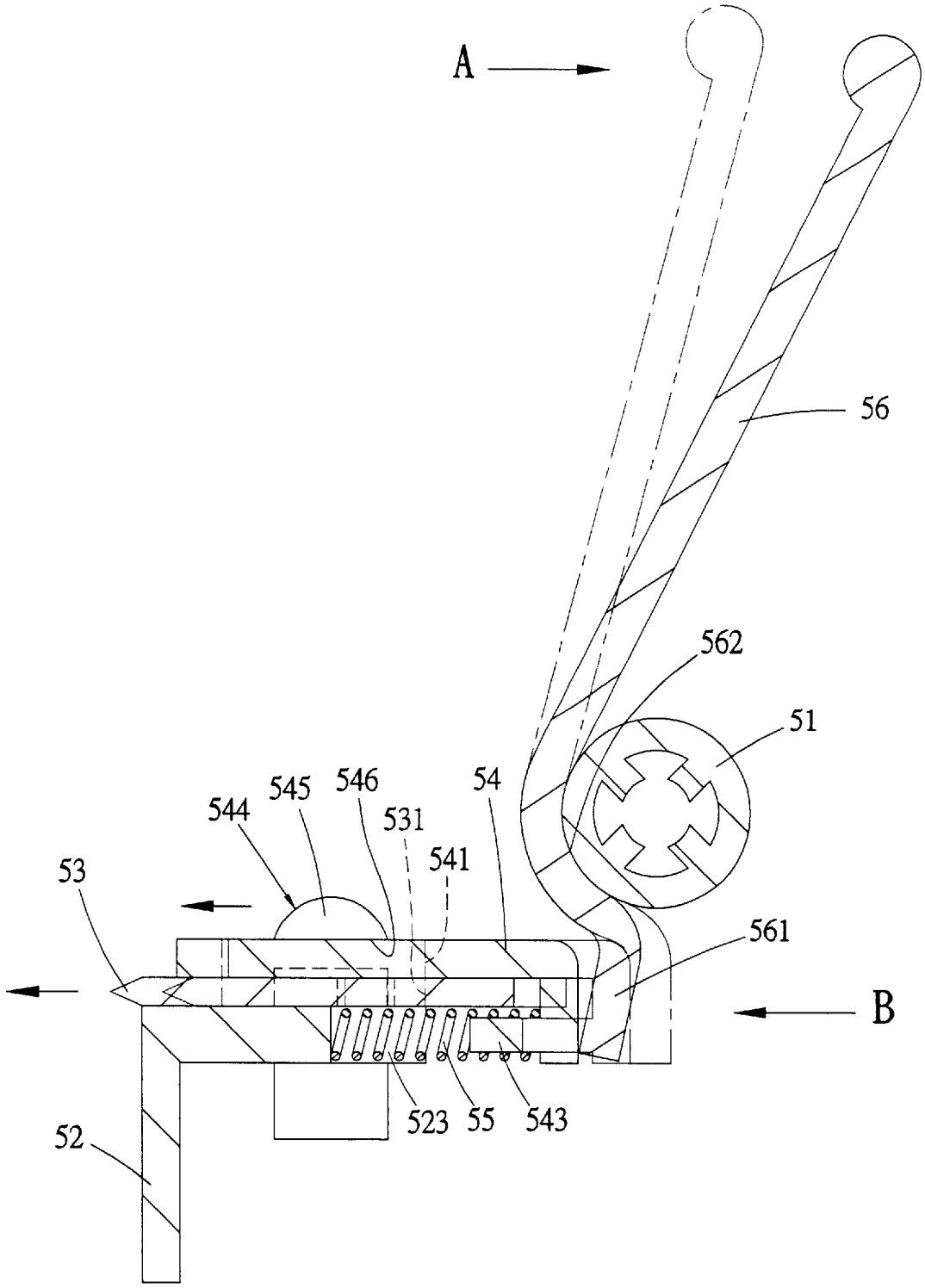
FIG. 5 is a side cross-sectional view of the first embodiment of the automatic cutting device assembled and operated in the present invention.

Subsequently, as shown in FIGS. 4 and 5, the blade 53 and the slide base 54 are orderly mounted on the blade holder 52, with the slide holes 531 and 541 of the blade 53 and the slide base 54 together fitted around the fixing studs 522 of the blade holder 52 and fixed therein by means of bolts 544. The bolt 544 is only used to keep the blade 53 and the slide base 54 in place, but the bottom side 546 of its bolt head 545 doesn't closely contact with the top side of the slide base 54, so that the slide holes 531 and 541 are capable to slide along the fixing studs 522, and the slide base 54 and the blade 53 are restricted to shift back and forth only.

At the same time, the position studs 542 of the slide base 54 are inserted through the position holes 532 of the blade 53 and then get in the slide grooves 524 of the blade holder 52 to let the slide base 54 move the blade 53. Then, the spring 55 has both ends respectively push against the projecting stud 543 of the slide base 54 and the spring receiving groove 523 of the blade holder 52 so as to enable the slide base 54 recover its position quickly by the resilience of the spring 55.

Lastly, the press plate 56 has its curved support member 562 inserted sideward between the slide base 54 and the support rod 51, letting the curved support member 562 push against the support rod 51 and the push plate 561 push against the rear side of the slide base 54.

In using, as shown in FIG. 5, firstly, the tape on the adhesive-tape roller 30 is pulled out to pass around the roller 20 and get onto the press plate 56. Next, the adhesive tape is glued on an article to be adhered and then pulled out smoothly by rotating the roller 20 and flattened synchronously by the end edge of the press plate 56.

When the tape is needed to be cut off, just forcefully press the handle 12 down on the adhered article to let the top end of the press plate 56 produce an action (A) and the push plate 561 give rise to a reaction (B) at the same time to push the slide base 54, with the support rod 51 supporting the support member 562 of the press plate 56 and serving as a fulcrum. Under this condition, the pushing force of the reaction (B) is larger than the resilience of the spring 55 so the push plate 561 can push the slide base 54 together with the blade 53 to move forward and cut off the adhesive tape.

On the contrary, in case the pressing force of the handle 12 is released from the article being adhered, the slide base 54 will quickly recover its position by the resilience of the spring 55, and at the same time the position studs 542 of the slide base 54 will fit in the position holes 532 of the blade 53, so that the blade 53 can be moved back to its original position, ensuring safety in using.

Figure 6:
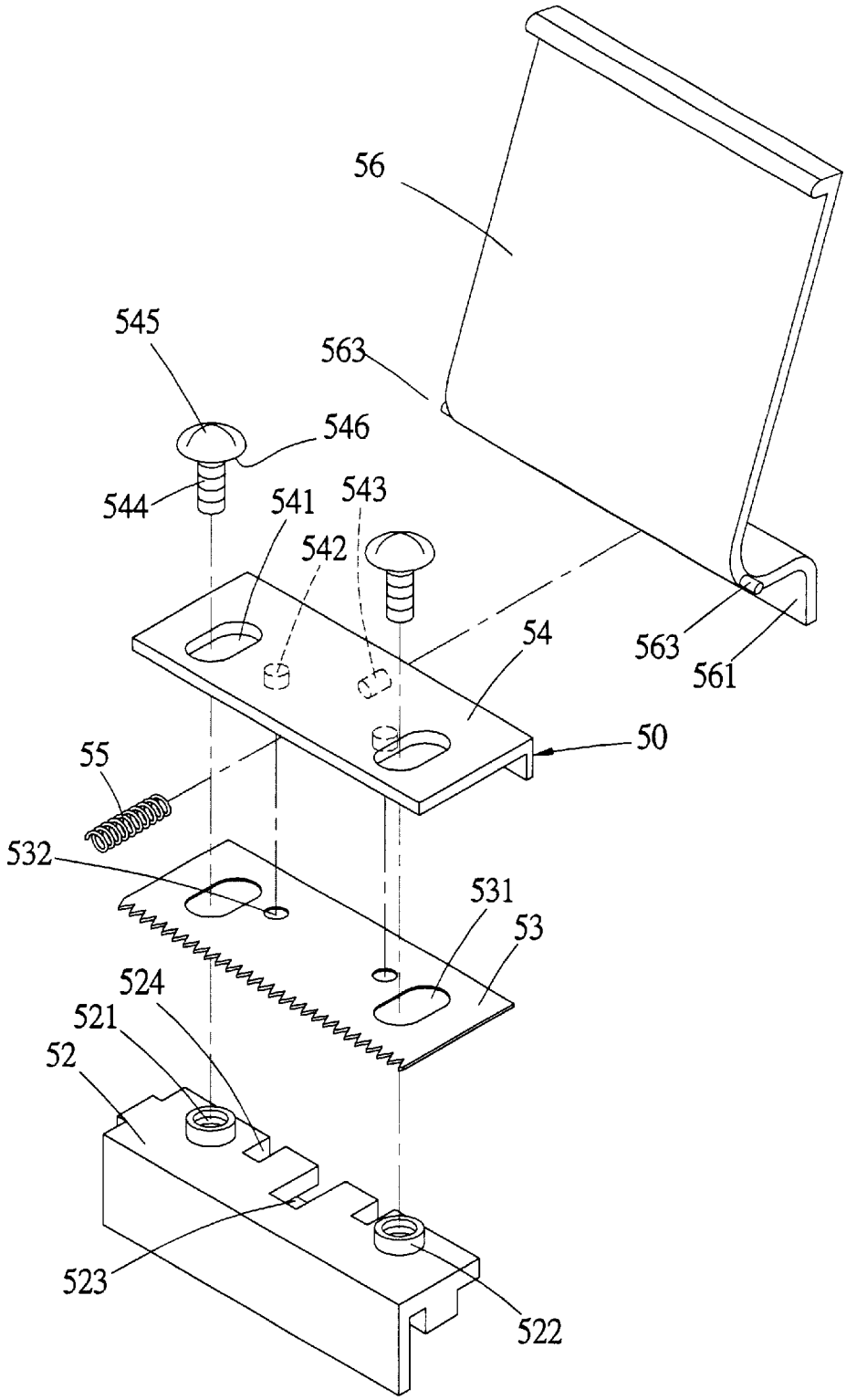
FIG. 6 is an exploded perspective view of a second embodiment of an automatic cutting device in the present invention.

Another preferred embodiment of an adhesive-tape holder with an openable side cover in the present invention, as shown in FIG. 6 is to have both sides of the press plate 56 of the cutting device 50 respectively provided with a pivotal stud 563 to be pivotally connected with the side wall of the side plate 11 and the side cover 40, needless to be supported with a support rod 51 but equally enabling the lower push member 561 of the press plate 56 push forward the slide base 54 together with the blade 53 to carry on cutting of the adhesive tape.

While the preferred embodiments of the invention have been described above, it will be recognized and understood that various modifications may be made therein and the appended claims are intended to cover all such modifications that may fall within the spirit and scope of the invention.

I claim:

1. The adhesive-tape holder with an openable side cover comprising:

a) a stationary side plate;

b) a handle provided under one side of said stationary side plate;

c) an adhesive-tape roller base fixed on one end of said side plate for fitting an adhesive-tape roller;

d) a roller provided at a front end of said side plate, said adhesive-tape roller base provided centrally with a combining tube horizontally extending laterally from said side plate, a roller support tube extending laterally from said side plate for receiving said roller provided at a front end of the side plate, and a fitting tube positioned above said handle;

e) an openable side cover positioned on one side of the top of said handle, symmetrically located opposite to said side plate, said side cover provided with a first fitting rod to be inserted in said roller support tube of said side plate, said side cover having a combining tubular rod to be correspondingly received in said combining tube of said adhesive-tape roller base, said side cover further provided with a second fitting rod inserted in said fitting tube of said side plate;

f) an inner recess being formed on the circumferential surface of said adhesive-tape roller base, having a stop plate extending from an end and formed integral with said adhesive-tape roller base, and said stop plate has an open side blocking said adhesive-tape roller to prevent said roller from rotating in a reverse direction.

2. The adhesive-tape holder with an openable side cover comprising:

a) a stationary side plate;

b) a handle provided under one side of said stationary side plate;

c) an adhesive-tape roller base fixed on one end of said side plate for fitting an adhesive-tape roller;

d) a roller provided at a front end of said side plate, said adhesive-tape roller base provided centrally with a combining tube horizontally extending laterally from said side plate, a roller support tube extending laterally from said side plate for receiving said roller provided at a front end of the side plate, and a fitting tube positioned above said handle;

e) an openable side cover positioned on one side of the top of said handle, symmetrically located opposite to said side plate, said side cover provided with a first fitting rod to be inserted in said roller support tube of said side plate, said side cover having a combining tubular rod to be correspondingly received in said combining tube of said adhesive-tape roller base, said side cover further provided with a second fitting rod inserted in said fitting tube of said side plate;

f) a cutting device having:

i) a support rod disposed at a proper position of said side plate;

ii) a blade holder fixed on an inner side wall of said side plate and provided on top with two fixing studs respectively having a threaded hole, said blade holder further having a spring receiving groove formed in the center;

iii) a blade positioned on said blade holder and having two slide holes fitted around said fixing studs of said blade holder, said blade further bored with two position holes for receiving two position studs of a slide base;

iv) said slide base mounted on said blade to activate the blade to shift and having two slide holes formed on top side to correspond to said slide holes of said blade and a projecting stud located on its vertical short wall, and a spring having one end fitted around said projecting stud and the other end inserted in said spring receiving groove of said blade holder, said slide base further having two position studs extending downward to be inserted through said position holes of said blade; and, v) a press plate formed with a vertical push member at a bottom end to push said slide base, with a curved support member formed between an upper vertical press member of said press plate and said lower push member to rest against said support rod.

3. The adhesive-tape holder with an openable side cover comprising:

a) a stationary side plate;

b) a handle provided under one side of said stationary side plate;

c) an adhesive-tape roller base fixed on one end of said side plate for fitting an adhesive-tape roller;

d) a roller provided at a front end of said side plate, said adhesive-tape roller base provided centrally with a combining tube horizontally extending laterally from said side plate, a roller support tube extending laterally from said side plate for receiving said roller provided at a front end of the side plate, and a fitting tube positioned above said handle;

e) an openable side cover positioned on one side of the top of said handle, symmetrically located opposite to said side plate, said side cover provided with a first fitting rod to be inserted in said roller support tube of said side plate, said side cover having a combining tubular rod to be correspondingly received in said combining tube of said adhesive-tape roller base, said side cover further provided with a second fitting rod inserted in said fitting tube of said side plate;

f) a cutting device having:

i) a blade holder fixed on an inner side wall of said side plate and provided on top with two fixing studs respectively having a threaded hole, said blade holder further provided with a spring receiving groove in the center;

ii) a blade movably positioned on said blade holder and having two slide holes to be fitted around said fixing studs of said blade holder and two position holes for receiving two said position studs of a slide base;

iii) the slide base mounted on said blade and activating it to shift, said slide base bored with two slide holes on a top side, said two slide holes conforming to said slide holes of said blade, said slide base provided with a projecting stud on its vertical short wall, and a spring having one end fitted around said projecting stud and the other end inserted in said spring receiving groove of said blade holder, said slide base further having two position studs extending downward to be inserted through said position holes of said blade; and, iv) a press plate having two pivotal studs respectively provided at opposite side edges to be pivotally connected with said side plate and said side cover, said press plate formed with a vertical push plate for pushing forward said slide base.

4. The adhesive-tape holder with an openable cover as claimed in claim 2, wherein a slide groove is provided respectively at the left and the right side of said spring receiving groove of said blade holder, two position holes corresponding to said slide grooves are bored on said blade, and two position studs are fixed under said slide base, protruding downward to be inserted through said position holes and then get in said spring receiving groove.

5. The adhesive-tape holder with an openable cover as claimed in claim 3, wherein a slide groove is provided respectively at the left and the right side of said spring receiving groove of said blade holder, two position holes corresponding to said slide grooves are bored on said blade, and two position studs are fixed under said slide base, protruding downward to be inserted through said position holes and then get in said spring receiving groove.

* * * * *